US011452894B2

(12) United States Patent
Williams et al.

(10) Patent No.: US 11,452,894 B2
(45) Date of Patent: Sep. 27, 2022

(54) SECTIONAL FIRE PROTECTION FOR ATTIC SPACES

(71) Applicant: Tyco Fire Products LP, Lansdale, PA (US)

(72) Inventors: Matthew Craig Williams, Westport, MA (US); Luke Stevenson Connery, Rehobeth, MA (US); Sean E. Cutting, West Warwick, RI (US)

( * ) Notice: Subject to any disclaimer, the term of this patent is extended or adjusted under 35 U.S.C. 154(b) by 137 days.

(21) Appl. No.: 15/761,558

(22) PCT Filed: Oct. 26, 2016

(86) PCT No.: PCT/US2016/058893

§ 371 (c)(1),
(2) Date: Mar. 20, 2018

(87) PCT Pub. No.: WO2017/075070

PCT Pub. Date: May 4, 2017

(65) Prior Publication Data

US 2018/0256929 A1 Sep. 13, 2018

Related U.S. Application Data

(60) Provisional application No. 62/246,561, filed on Oct. 26, 2015.

(51) Int. Cl.
*A62C 37/38* (2006.01)
*A62C 35/62* (2006.01)
(Continued)

(52) U.S. Cl.
CPC ..... *A62C 37/38* (2013.01); *A62C 35/62* (2013.01); *A62C 35/68* (2013.01); *A62C 37/36* (2013.01)

(58) Field of Classification Search
CPC ..... A62C 35/62; A62C 35/68; A62C 37/38–42; A62C 37/36
(Continued)

(56) References Cited

U.S. PATENT DOCUMENTS 8,083,002 B1 * 12/2011 Golinveaux ..... A62C 35/60 169/16
2006/0289174 A1 * 12/2006 Yu ..... A62C 35/58 169/16
(Continued)

FOREIGN PATENT DOCUMENTS

JP 2000153005 6/2000
JP 2001340485 12/2001
(Continued)

OTHER PUBLICATIONS

Roger S. Wilkins, "The Use of Specific Application Sprinklers for Protecting Attics", Tyco Fire & Building Products; Tech. Reports and White Papers, Oct. 21, 2014; 10 pages. (Year: 2014).*
The Viking Corporation, "Deluge System Technical Manual for Operation, Maintenance, and Troubleshooting", Jun. 2009. (Year: 2009).*
(Continued)

*Primary Examiner* — Cody J Lieuwen
(74) *Attorney, Agent, or Firm* — Foley & Lardner LLP

(57) ABSTRACT

Sectional fire protection systems and methods for the protection of an attic space are provided. A fluid control thermal detection device is located above a ceiling base within a spherical radial distance proximate a peak region of the attic space. An open fluid distribution device is disposed between the roof deck and the ceiling base and connected to the fluid control thermal detection device for receipt of firefighting fluid from the fluid control thermal detection device.

19 Claims, 10 Drawing Sheets

(51) Int. Cl.
*A62C 35/68* (2006.01)
*A62C 37/36* (2006.01)

(58) Field of Classification Search
USPC ..... 169/56, 60, 61
See application file for complete search history.

(56) References Cited

U.S. PATENT DOCUMENTS

2007/0221388 A1* 9/2007 Johnson ..... A62C 35/58 169/16
2008/0128143 A1* 6/2008 Yu ..... A62C 35/605 169/16
2011/0024138 A1* 2/2011 Multer ..... A62C 3/0292 169/54
2015/0376897 A1* 12/2015 Bigelow ..... A62C 2/10 52/29
2016/0375287 A1* 12/2016 Meyer ..... B05B 1/265 169/16

FOREIGN PATENT DOCUMENTS

JP 2003164543 6/2003
WO WO2009108944 9/2009

OTHER PUBLICATIONS

National Fire Protection Association, National Fire Alarm and Signaling Code, 2013 Edition, pp. 72-96 (Year: 2013).*
Minimax, "Technical Data Sheet: MX8697 Attic Upright Specific Application Sprinkler K5.6", Dec. 18, 2004 (Year: 2004).*
Anonymous: "Series MJC Multiple Jet Control DN20, DN25, DN40, DN50, 12 bar BSPT Inlet & Outlets Threads", Tyco Fire Products Data Sheet TFP1346, Oct. 31, 2014; 10 pages.
Roger S. Wilkins, "The Use of Specific Application Sprinklers for Protecting Attics", Tyco Fire & Building Products; Tech. Reports and White Papers, Oct. 21, 2007, 84 pages.
International Search Report and Written Opinion of International Application No. PCT/US2016/058893 filed Oct. 26, 2016; dated Jan. 19, 2017; 7 pages.

* cited by examiner

SECTIONAL FIRE PROTECTION FOR ATTIC SPACES

PRIORITY CLAIM, CROSS-REFERENCE & INCORPORATION BY REFERENCE

This application is a 35 U.S.C. § 371 application of International Application No. PCT/US2016/058893 filed Oct. 26, 2016, which claims the benefit of priority to U.S. Provisional Patent Application No. 62/246,561, filed Oct. 26, 2015, each of which is incorporated by reference in its entirety.

TECHNICAL FIELD

The present invention relates generally to fire protection systems and more specifically to fire protection systems for the protection of attic spaces.

BACKGROUND ART

Under the fire protection industry standard, National Fire Protection Association NFPA 13: Standard for the Installation of Sprinkler Systems, (2013 ed.), criteria is specified for the installation of fire protection sprinkler systems for attic spaces. The installation criteria can include sprinkler spacing and location requirements and application density requirements for sprinklers in order to protect attic spaces with peaked or sloped roofs including protection of the eaves regions, the eaves corner and the areas along the base. Current attic fire protection systems employ "automatic sprinklers." NFPA 13 defines an "automatic sprinkler" as "a fire suppression or control device that operates automatically when its heat-activated element is heated to its thermal rating or above, allowing water to discharge over a specified area." The installation requirements can require that automatic sprinklers be installed in each of the peak and eaves regions in order to provide for the designed fire protection including satisfaction of, for example, the 0.1 gallon per square foot (0.1 GPM/SQ. FT.) density requirement.

FIG. 8.6.4.1.4 of Section 8.6.4.1.3 of NFPA 13 shows an attic space. Generally, the attic space is defined by the intersection of the joists of the roof deck with the joist of the base or ceiling deck and the rise-to-run ratio or pitch from the intersection to the peak of the roof. For the purpose of designing for fire protection of the attic space, the eaves region of the pitched roof is the triangular sections at the outer edge of the attic space and lateral of the roof peak when viewed in elevation. Moreover, for the purpose of fire protection of the eave region, the eaves region is defined by the intersection of the roof and ceiling joists and the distance to the first sprinkler disposed medially of the intersection. The location of this first medial sprinkler relative to the intersection defines the vertical of the eaves region to the ceiling deck and the horizontal of the eaves region along the ceiling deck. The location of the first medial sprinkler relative to the intersection of the roof and ceiling joists also defines the hypotenuse of the triangular eaves region in the direction of the sloping roof joists. Section 8.6.4.1.4.3 of NFPA 13 specifies that, for a roof slope of 4 in 12 or greater, the first medial sprinkler is not to be less than five feet (5 ft.) from the intersection of the roof and ceiling joists in the direction of slope. It is believed that, in order to satisfy the preferred 0.1 gpm/sq. ft. density, the first medial sprinkler in known systems using only automatic sprinklers is located at a maximum distance from deflector to the roof ranging from 1 inch to a 22 inches.

These current system requirements can pose various problems for complying with design and installation requirements due to unforeseen obstructions and thermal dynamics including, for example, fire growth patterns and the limited thermal responsiveness of automatic sprinklers. For example, automatic sprinkler installation and spacing which locate sprinklers at the five foot minimum distance from the roof and ceiling joist intersection for protection of the eave regions can require installations in low clearance areas below the roof. Additionally, the number of sprinklers in the peak and the eaves contribute to the overall fluid or water demand of the system. Known fire protection systems include Tyco Fire Products LP (Tyco Fire & Building Products—Research & Development) entitled "Application: The Use of Specific Application Sprinklers for Protecting Attics" (December 2007), which shows system designs using specific application sprinklers which reduce hydraulic demand over systems using only standard spray sprinklers. There is a continued desire for systems which minimize, reduce and/or eliminate installations in the lower clearance area of the eaves region and for systems which can reduce overall hydraulic demand.

DISCLOSURE OF INVENTION

Systems and methods are provided for attic space fire protection. One or more sectional fire protection sub-systems provide fire protection of an attic space defined by a ceiling base and a roof deck disposed above the ceiling base, the roof deck being sloped with respect to the ceiling base and toward a ridge formation to define a peak and an eaves region. Preferred sectional fire protection sub-systems include at least one fluid control thermal detection device located above the ceiling base proximate the peak region and more preferably within a maximum radial distance of the peak of the peak region. The fluid control thermal detection device includes an inlet and at least one outlet. The systems further preferably include at least one open fluid distribution device disposed between the roof deck and the ceiling base and a pipe connected to the at least one outlet of the at least one fluid control thermal detection device for receipt of firefighting fluid from the fluid control thermal detection device. A preferred method of attic space fire protection is also provided. The preferred method includes locating at least one fluid control thermal detection device having an inlet and at least one outlet above the ceiling base within a maximum radial distance of the peak region. The method also includes piping at least one open fluid distribution device for connection to the at least one outlet.

Embodiments of the sub-system include preferred arrangements of the fluid control and fluid distribution devices to provide protection of zoned or sectional areas of the attic space. Moreover, preferred locations of the fluid distribution devices are preferably at medial distances from the eaves regions to provide sufficient fluid distribution density in the eaves regions while avoiding or minimizing the low clearance and obstruction issues of the previously known installations. In one preferred aspect, the preferred systems lower the hydraulic demand of the system by providing sufficient protection with a lower distribution density, e.g., less than 0.1 GPM/SQ. FT. and more preferably a distribution density ranging from 0.05 GPM/SQ. FT. to less than 0.1 GPM/SQ. FT. Alternatively or additionally, preferred embodiments of the systems are believed to reduce the hydraulic demand over known systems by reducing the total number of sprinklers used to protect the same attic space.

BRIEF DESCRIPTION OF DRAWINGS

The accompanying drawings, which are incorporated herein and constitute part of this specification, illustrate exemplary embodiments of the invention and, together with the general description given above and the detailed description given below, serve to explain the features of the invention. It should be understood that the preferred embodiments are some examples of the invention as provided by the appended claims.

MODE(S) FOR CARRYING OUT THE INVENTION

Figure 1A:
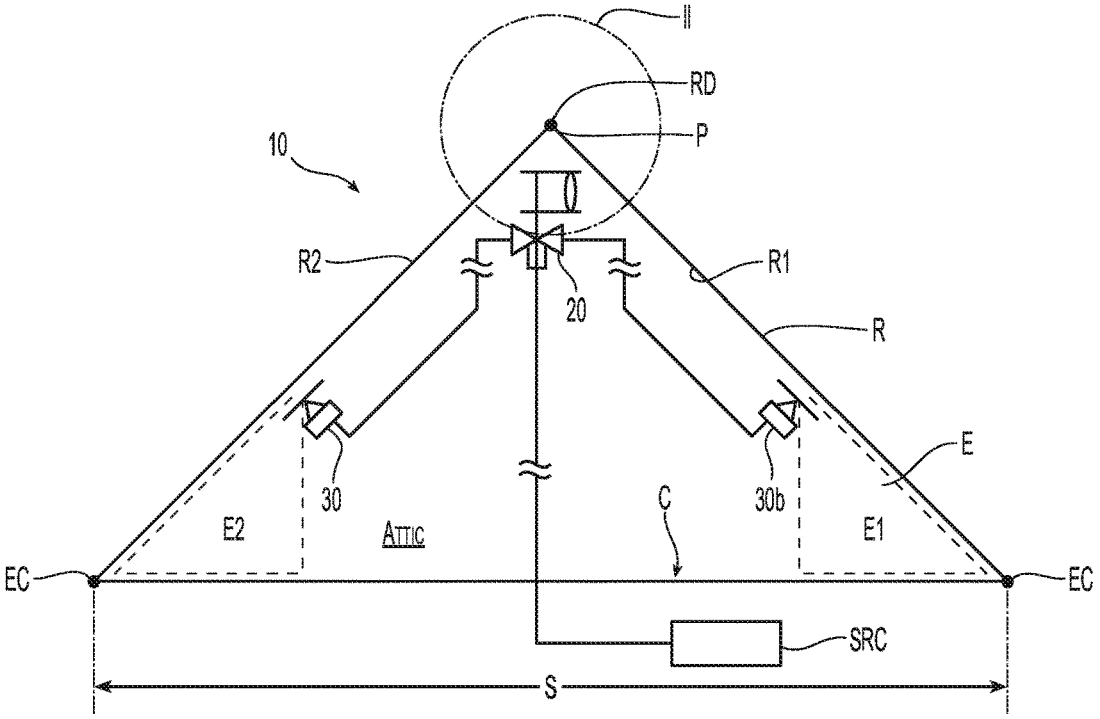
FIG. 1A is a schematic elevation view of a preferred sectional fire protection system for an attic space.
Figure 1B:
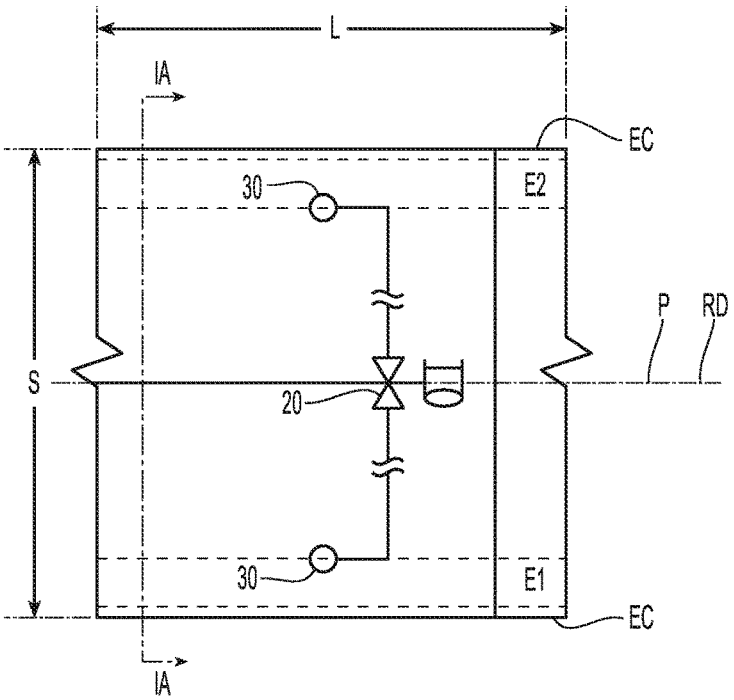
FIG. 1B shows a schematic plane view of the system of FIG. 1A.

Shown in FIGS. 1A-1B is a preferred embodiment of a sectional fire protection system 10 for the protection of a combustible concealed space between a roof deck R and a ceiling base C and more preferably a fire protection system for the protection of an attic space ATTIC. The roof deck R is preferably sloped toward a ridge formation RD to define a slope (rise:run) of 2:12 or greater, preferably 4:12 or greater such as, for example, 8:12, 10:12 and even more preferably 12:12. The roof deck R can include two portions R1, R2 which slope toward and intersect at the ridge formation RD. Although the two portions R1, R2 of the roof deck R are shown as having equal slopes, it should be understood that the two portions can define different slopes. Extending from the roof deck at or proximate the ridge formation RD can be one or more baffles or DC, as seen for example in FIGS. 3D-3E, to partially divide the attic space ATTIC into two or more section or zones. The one or more draft curtain DC can extend parallel to the ridge formation RD or alternatively, extend perpendicular to the ridge formation RD in a spaced apart arrangement. An exemplary attic space ATTIC is further defined by a span S of the horizontally extending ceiling base C and outer eaves region(s) E. Preferred systems described herein preferably protect attic spaces or portions thereof having a span S of no more than eighty feet (80 ft.), such as for example, up to sixty feet (60 ft.); up to forty feet (40 ft.), up to twenty feet (20 ft.) or less.

In the elevation view of the attic space ATTIC and preferred embodiment of the fire protection sectional system 10 in FIG. 1A, the outer eaves regions E can include a first eave region E1 and second eave region E2 disposed laterally about the ridge formation RD and a peak region P. As used herein, a "peak region" P is defined as a high point in the attic space ATTIC beneath the roof deck either along the ridge formation RD or along the intersection between a roof deck portion R1, R2 and a draft curtain. Each of the eaves regions E1, E2 is defined by the intersection EC of the roof deck R and ceiling base C. Each of the eaves regions E1, E2 can be further defined by the linear distance to a firefighting fluid distribution device 30 disposed medially of the intersection EC in the direction from the intersection EC to the peak P either measured parallel to the roof deck R or the ceiling base C. Alternatively, the eaves regions E1, E2 can be defined by a minimum vertical height from the ceiling base C to the fluid distribution device 30.

Generally, the preferred sectional fire protection system 10 includes one or more fluid control thermal detection device(s) 20 proximate the peak region P which delivers a firefighting fluid to one or more fluid distribution devices 30 as a controlled response upon detecting one or more products of combustion in the peak region P. The fluid distribution devices 30 are preferably pipe connected to the fluid control thermal detection devices 20 in an open state and spaced about the attic space ATTIC to distribute the firefighting fluid and provide for wetting of surfaces and to address the detected fire and even more preferably suppress the fire. As described herein, the fluid distribution device 30 can be embodied as a fire protection sprinkler, a fire protection nozzle or any other fluid carrying conduit capable of dispersing firefighting fluid in a manner described herein. Depending upon its type, the device 30 can include a fluid deflector or diffuser to define a coverage area of the device 30. Because the fluid distribution devices 20 are connected in an open state to the fluid control device 30, the preferred system 10 thus provides for one or more deluge subsystem(s) for sectional fire protection of the attic spaces ATTIC in which fluid delivery control and fire detection are coupled together and located in the region of the attic in which the products of combustion collect, i.e., in the peak region P. By employing a deluge configuration to protect the attic space, the preferred system 10 separates the fire detection and fluid distribution between distinctly located components of the system so as to overcome the problems encountered in known attic fire protections systems generated by the fire dynamics in attics.

Figure 2:
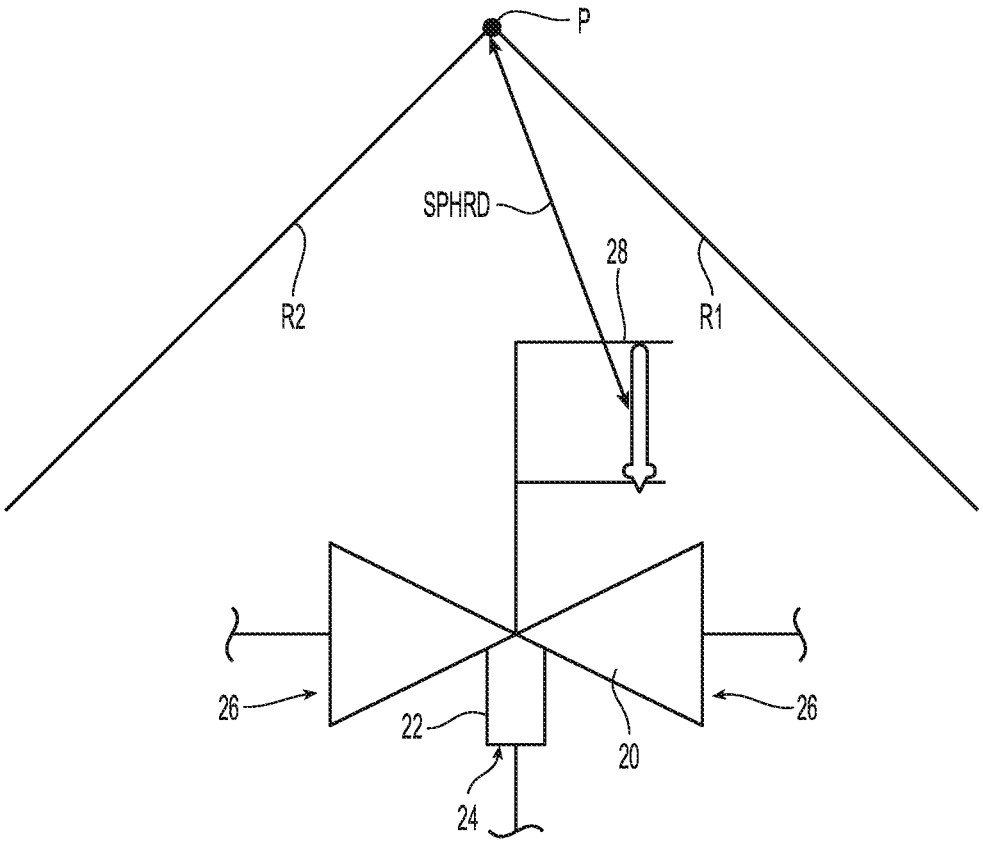
FIG. 2 is a detailed view of an installed fluid control thermal detection device in the system of FIG. 1A.

Referring to FIGS. 1A and 2, the fluid control thermal detection device 20 includes a valve body 22 having an inlet 24 pipe connected to a source SRC of firefighting fluid and one or more outlet(s) 26 pipe connected to the one or more fluid distribution devices 30. The piping connections can include appropriately sized main pipe, fittings, cross-mains, branch lines, sprigs and/or drops to appropriately hydraulically supply each of the fluid control devices 20 and fluid distribution devices 30 with an operative fluid pressure. The preferred valve body 22 has an internal closed or sealed configuration to prevent fluid flow between the inlet 24 and the outlet(s) 26. The valve body 22 also has an internal open or unsealed condition in which a firefighting fluid can flow from the inlet 24 to the outlet 26 for discharge from the outlet 26. To control the valve internals between its sealed and unsealed conditions, the preferred fluid control thermal detection device 20 includes a thermal spot detection assembly 28 that is linked with the valve body 22. The thermal spot detection assembly 28 preferably includes a thermally responsive element that detects environmental conditions indicative of a fire, i.e., temperature rise, smoke particles, etc., proximate the valve. Upon detecting a fire condition, the thermal spot detection assembly 28 in its linked arrangement with the valve body 22, operates the valve body 22 from its closed configuration to its open configuration to permit internal flow of the firefighting fluid from the inlet 24 to the outlet(s) 26 for delivery to the one or more fluid distribution devices 30.

The preferred system 10 overcomes the disadvantages of the known fire attic space fire protection systems by coupling and locating fire detection and fluid control functions proximate the peak region P. In the case of a fire beneath a sloped ceiling, as previously described, the products of combustion, e.g., heat and smoke, travel and rise up the sloped roof deck R and collect in the peak region P. As shown in FIG. 2, in one preferred embodiment of the sectional fire protection system 10, the fluid control thermal detection device 20 is located above the ceiling base C within a preferred spherical radial distance SPHRD of the peak region P. The spherical radial distance SPHRD is preferably minimized to maximize the clearance between the ceiling base C and the device 20 while locating the thermal spot detection assembly 28 within the area of collected products of combustion to thermally trigger operation of the fluid control device 20 in the event of a fire. In a preferred aspect, the spherical radial distance SPHRD at its maximum is sufficient for the fluid control thermal detection device 20 to be timely actuated by a fire located one foot (1 ft.) in from the eave region E such that the connected fluid distribution devices 30 receive and distribute firefighting fluid to address the fire and minimize or prevent burn through of the roof deck R. Preferably, the thermal spot detection assembly 28 is located within a maximum radius of the peak region P of no more than two feet (24 in.) and more preferably no more than four inches (4 in.). The thermal spot detection assembly 28 can be located within a radius of the peak region P within a preferred range of six to twenty-four inches (6 in.-24 in.) more preferably ranging from twelve to eighteen inches (12 in.-18 in.). Accordingly, the spot thermal detection assembly can be located within incremental lengths of the preferred ranges, for example anywhere from 22 in., 20 in., 18, in., 16 in., 14 in., 12 in., 10 in., 8 in., 6 in. or any length in between of the peak region P. Upon detecting a fire condition, the fluid control thermal detection device 20 operates to deliver firefighting fluid to the one or more fluid distribution devices 30 which are located to effectively address the fire.

An exemplary embodiment of a fluid control thermal detection device 20 for use in the system 10 can include, for example, the MODEL TCV-1 THERMAL CONTROL VALVE from Tyco Fire Products LP, shown and described in Tyco Fire Products LP Data Sheet TFP1345 entitled, "Model TCV-1 Thermal Control Valve 1 and 1½ Inch (DN25 and D40), 175 psi (12.1 bar) Thread×Thread" (January 2005). Another exemplary embodiment of a fluid control thermal detection device for use in the system 10 includes, for example, the MJC MULTIPLE JET CONTROL VALVE from Tyco Fire Products LP, shown and described in Tyco Fire Products Data Sheet TFP1346 entitled, "Series MJC Multiple Jet Controls DN20, DN25, DN40, DN50, 12 bar BSPT Inlet & Outlets Threads" (October 2014). Each of these known thermally responsive fluid control valves includes an integrated or internal thermal spot detection assembly 28 for actuating the valve. Generally, each device includes an internal sealing assembly that is held in the sealed position by either a fusible assembly or a thermally responsive bulb. Once the fusible assembly separates or the bulb fractures in response to the higher temperatures from a fire, the internal sealing assembly moves to an open position and fluid at the inlet of the valve is discharged from the valve outlets for delivery to the fluid distribution devices. Accordingly, the preferred fluid control thermal detection device 20 includes a thermally responsive trigger. The trigger of the fluid control devices described herein can be modified with an electrically responsive actuator and coupled to a controller, or other electrical signaling device, to provide for electronic controlled operation of the device 20 for fluid delivery to the open distribution devices 30. The device is schematically shown in FIG. 1A coupled to the firefighting fluid source SRC in a wet pipe system. Alternatively, the device 20 can be supplied by a dry pipe arrangement. Other valve arrangements can be used as the fluid control device provided the arrangement includes a thermal spot detection assembly to control valve operation and fluid flow therethrough.

The fluid distribution device(s) 30 are pipe connected to the outlet 26 of the fluid control thermal detection device 20 for receipt of the firefighting fluid for distribution. The number of fluid distribution devices and their spacing is preferably determined so as to provide a preferred fluid distribution density over the zone or area protected by a given sub-system of the system 10. A preferred provided distribution fluid density ranges from 0.05-0.1 GPM/SQ. FT. and more preferably ranges from 0.05 GPM/SQ. FT. to less than 0.1 GPM/SQ. FT. and even more preferably is 0.05 GPM/SQ. FT.

Referring again to FIGS. 1A and 1B, the fluid distribution device(s) 30 are vertically disposed between the roof deck R and the ceiling base C. The fluid distribution device(s) 30 also are preferably vertically located between the ceiling deck C and the fluid control thermal detection device 20. Various embodiments described herein can alternatively locate the fluid control thermal detection device 20 and the fluid distribution device(s) 30 at substantially the same height from the ceiling base C. For example, a fluid distribution device 30 can be embodied as a sprinkler with a deflector and the sprinkler can be vertically disposed to define a desired sprinkler-to-peak distance or a desired deflector-to-roof deck distance. In one preferred aspect, a preferred sprinkler-to-peak distance can be sized relative to the spherical radial distance SPHRD of the system, for example, it can be equal to or greater than, a percentage or multiple thereof. As seen in FIG. 3E illustrates a preferred sprinkler-to-peak distance can be two to four times the spherical radial distance when the fluid distribution device is located between the ceiling base C and the fluid control thermal detection device 20.

Moreover, as described herein, preferred embodiments of the system arrange the fluid distribution devices 30 relative one another, relative to the fluid control thermal detection device 20, and relative to structures of the attic space ATTICS to provide for the desired fluid distribution in the attic space and its sectioned zones or areas. In particular, the fluid distribution devices 30 are preferably spaced relative one another to provide the preferred fluid distribution density ranging from 0.05 GPM/SQ. FT. to less than 0.1 GPM/SQ. FT. and even more preferably is 0.05 GPM/SQ. FT. In preferred embodiments of the systems described herein, the number of sprinklers can be reduced over prior known systems to reduce the overall hydraulic demand.

Additionally or alternatively, preferred fluid distribution arrangements can locate the fluid distribution devices 30 at greater medial distances from the intersection EC of the roof R and ceiling base C to avoid the clearance issues of prior known systems. For example, depending upon the attic space configuration, the fluid distribution device 30 can also be located laterally or offset from the ridge formation RD; or alternatively, the fluid distribution device 30 can be aligned with the ridge formation RD. Accordingly for some preferred arrangements, the fluid distribution device 30 is preferably located between an eaves regions E and the fluid control thermal detection device 20 and in alternate embodiments, the fluid distribution devices 30 are disposed in a common plane with the fluid control thermal detection device 20 and the peak P. The fluid distribution device(s) 30 can also be disposed to locate their fluid distribution components, such as a deflector member, in a desired location relative to a structure of the attic space. For example, the first medial fluid distribution device 30 from the eaves regions E can be located at a preferred minimum medial distance to provide for effective fluid density distribution within the eaves regions while overcoming low clearance or obstruction issues. In a preferred aspect, the preferred minimum medial distance to the first fluid distribution device 30 from the intersection EC of the ceiling base C and the roof deck R is eight to ten feet (8 ft.-10 ft.) and more preferably eight to twelve feet (8 ft.-12 ft.). FIG. 1B schematically shows one preferred system arrangement in which one or more fluid distribution devices 30 are laterally spaced from the fluid control device 20, which is aligned with the peak P and preferably aligned with the ridge formation RD. The fluid distribution device(s) 30 can be aligned with one another and off-set from the fluid control device 20 in the direction from the first eaves region E1 to the second eaves region E2 over the span S of the attic space ATTIC.

Figure 3A:
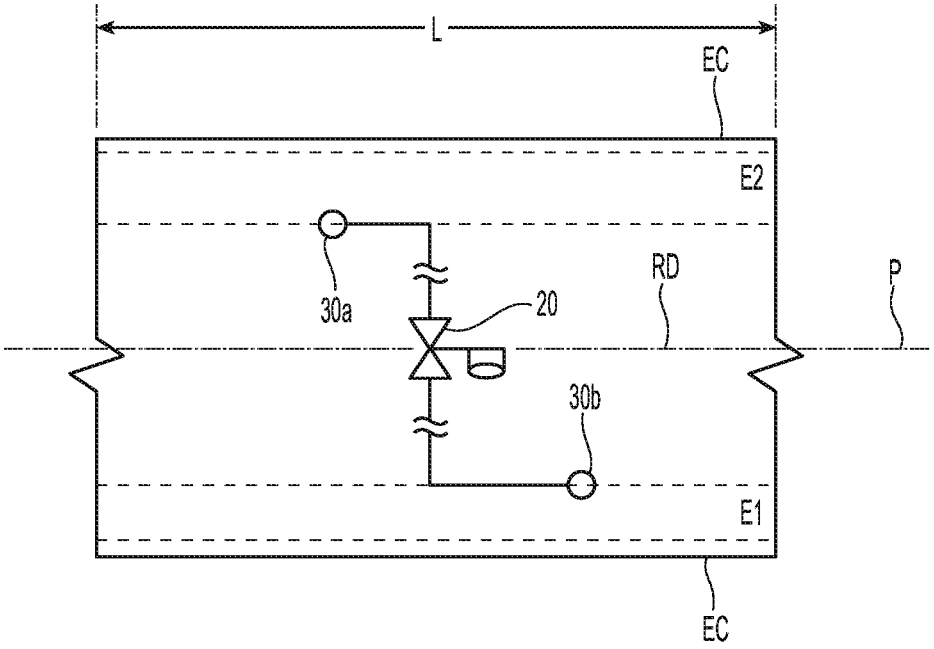
FIGS. 3A-3E are various alternate embodiments of a sectional fire protection system.
Figure 3B:
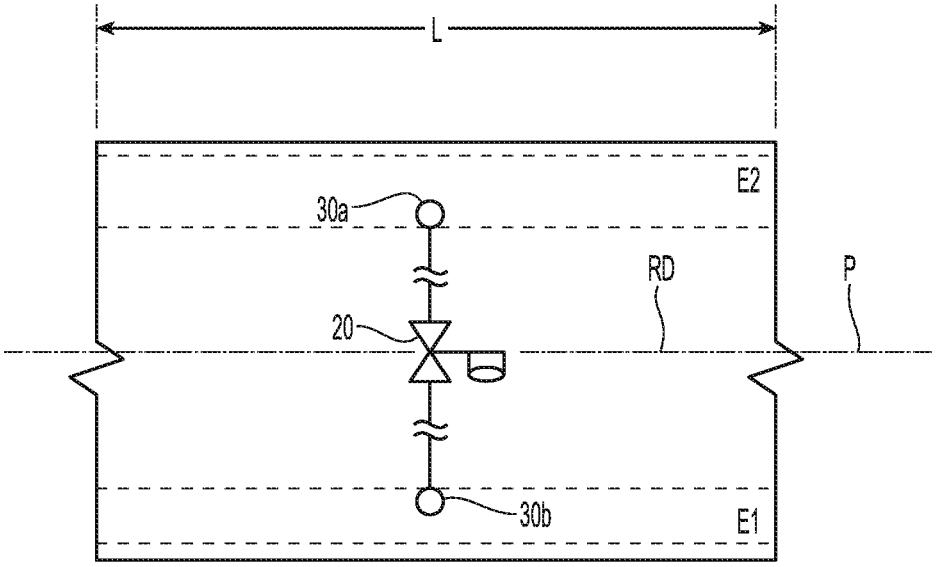
Figure 3C:
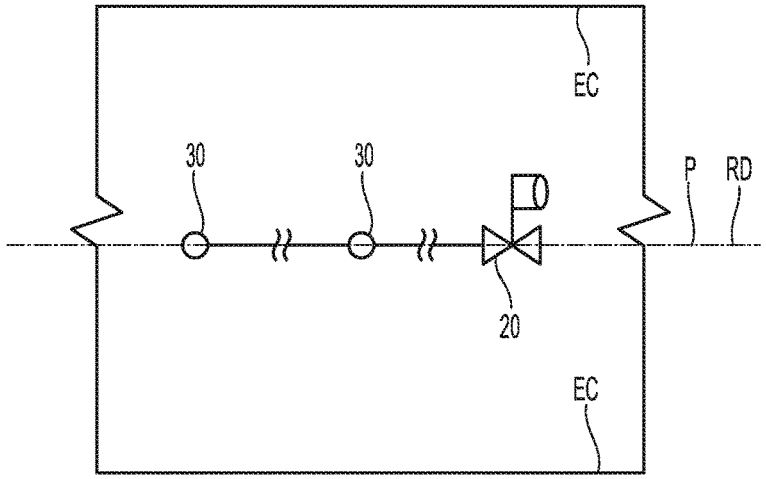
Figure 3D:
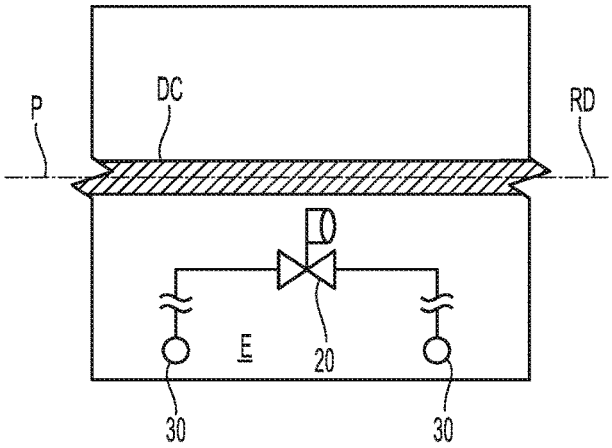
Figure 3E:
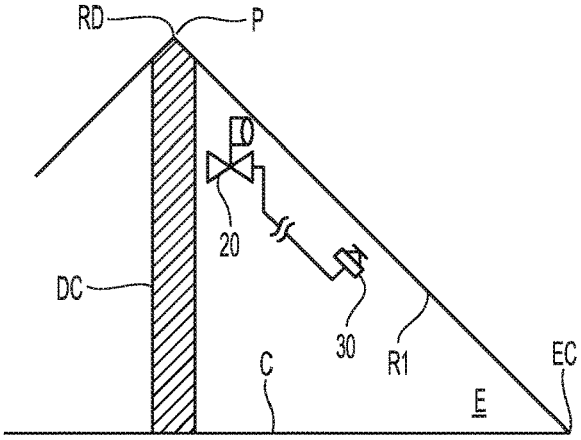

Shown in FIGS. 3A-3E are various preferred plan view layouts of a preferred deluge sub-systems in which at least two fluid distribution devices 30 are pipe connected to a common fluid control thermal detection device 20. The deluge sub-systems can be used in combination in the preferred sectional fire protection systems described herein. The figures illustrate preferred relative locations of the fluid control thermal detection device 20 and the fluid distribution device(s) 30 relative to one or more of the attic space peak P, ridge formation RD, eaves regions E and/or a baffles or draft curtains DC. In FIG. 3A, two fluid distribution devices 30*a*, 30*b* are disposed laterally about the fluid control thermal detection device 20, which is aligned with the peak P and the ridge formation RD. The distribution devices 30*a*, 30*b* are staggered and offset from one another in the direction from eave region-to-eave region E1, E2. Shown in FIG. 3B, the two fluid distribution devices 30*a*, 30*b* are laterally disposed about the co-aligned fluid control thermal detection device 20, peak P and ridge formation RD. The distribution devices 30*a*, 30*b* are aligned with one another and preferably aligned with the fluid distribution device 20 in the direction from eave region-to-eave region E1, E2. Shown in FIG. 3C, two fluid distribution devices 30*a*, 30*b* are aligned with the fluid control thermal detection device 20. The distribution devices 30*a*, 30*b* are aligned with one another and axially spaced from the fluid distribution device 20 in the direction parallel to the length L of the peak or ridge formation RD.

In FIGS. 3D and 3E, the two fluid distribution devices 30*a*, 30*b* and the fluid control thermal detection device 20 are shown disposed laterally of a baffle or draft curtain DC that extends along the peak P and ridge formation RD with the fluid control thermal detection device 20 proximate the peak region P. The fluid distribution devices 30 are preferably disposed between one of the eaves regions E and the fluid control thermal detection device 20. Depending on the exemplary embodiments shown and described herein, the piping connecting between the fluid distribution device(s) 30 and the fluid control thermal detection device 20 can be any one of parallel to, perpendicular to, or skewed or a combination thereof relative to the ridge formation RD, draft curtain DC, peak P and/or roof deck R. Moreover, the piping can be steel piping or alternatively CPVC Piping in accordance with the acceptable use standards as described in the 2007 publication from Tyco Fire Products LP (Tyco Fire & Building Products —Research & Development) entitled "Application: The Use of Specific Application Sprinklers for Protecting Attics" (December 2007), hereinafter "Tyco Publication".

Figure 4A:
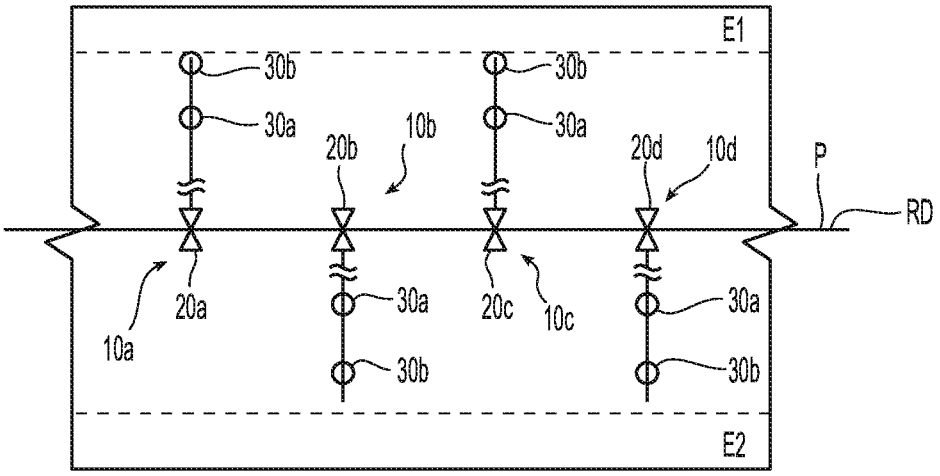
FIG. 4A is a plan schematic view of a preferred attic fire protection system using a plurality of preferred sectional fire protection systems.

FIGS. 3A-3E are illustrative embodiments of preferred single sectional fire protection sub-system layout. The preferred systems can be replicated and/or combined to provide for a preferred sectional fire protection system for fire protection of the full attic space or large portions thereof. For example, shown in FIG. 4A is an attic space ATTIC protected by a group of axially spaced deluge sub-systems 10*a*, 10*b*, 10*c*, 10*d* each having one fluid control thermal detection device 20*a*, 20*b*, 20*c*, 20*d* proximate the peak P with two fluid distribution devices 30*a*, 30*b* coupled to the fluid control device 20. The sub-systems are preferably arranged so that the fluid distribution devices are located between the fluid control devices 20 and one of the eaves E in an alternating fashion. Additionally or alternatively, one or more draft curtains DC (not shown) can depend from and extend in a direction either parallel to or perpendicular to the P and ridge formation RD. Thus as shown, the sectional systems 10*a*, 10*b*, 10*c*, 10*d* are oriented with respect to one another to provide for a preferably staggered arrangement in which the fluid control thermal detection devices 20*a*, 20*b*, 20*c*, 20*d* and their respective pairs of fluid distribution devices 30*a*, 30*b* are alternately positioned about the peak P and aligned in a direction toward the opposed eaves E1, E2. In a preferred embodiment, the fluid control thermal detection devices 20*a*, 20*b*, 20*c*, 20*d* and their respective fluid distribution devices 30 are spaced from another and hydraulically supplied such that they provide a preferred maximum distribution density ranging from 0.05-0.1 GPM/SQ. FT and more preferably 0.05 GPM/SQ. FT. to less than 0.1 GPM/SQ. FT.

Figure 4B:
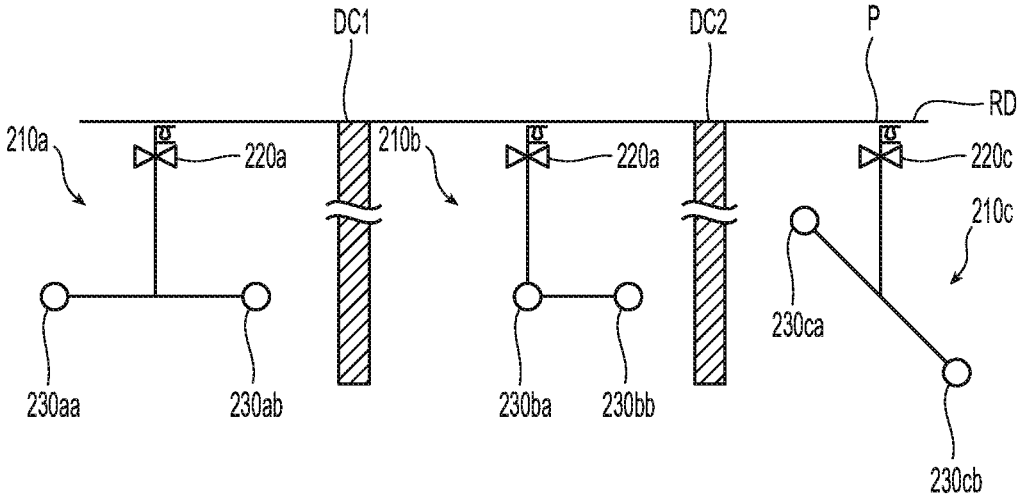
FIG. 4B is a plan side view of another preferred attic fire protection system using a plurality of preferred sectional fire protection systems.

In an alternate embodiment of the system 200, shown in elevation in FIG. 4B, having two or more and preferably three or more sub-systems 210*a*, 210*b*, 210*c* each having a fluid control thermal detection device 220 disposed proximate the peak region P with two fluid distribution devices 230*a*, 230*b* coupled to and depending about the fluid distribution device 230. In a preferred arrangement, the first sectional system 210*a*, the fluid distribution devices 230*aa*, 230*ab* are aligned along the peak P beneath the ridge formation RD. In the second sectional system 210*b*, a first fluid distribution device 230*ba* is axially aligned with the fluid distribution device 230*b* and the second fluid distribution device, 230*bb* axially is spaced from the first distribution device and aligned with the peak P. In the third sectional system 210*c*, the fluid distribution devices 230*ca*, 230*cb* are axially aligned with one another and skewed with respect to the peak P and more preferably extend perpendicular to the peak P. In a preferred embodiment, the fluid control devices 220*a*, 220*b*, 220*c* and their respective fluid distribution devices 230*a*, 230*b* are spaced and hydraulically supplied to provide for 0.05-0.1 GPM/SQ. FT. and more preferably 0.05

GPM/SQ. FT. to less than 0.1 GPM/SQ. FT from each sectional system 210*a*, 210*b*, 210*c* upon the operation of a maximum of two fluid control thermal detection devices 220*a*, 220*b*, 220*c*.

Alternatively to mixing sub-systems of varying configurations, a system can be constructed by replicating a preferred sub-system, for example, first sectional system 210*a*. In another alternative embodiment, two or more of the first sectional systems 210*a* can be disposed laterally about the ridge formation RD instead of vertically aligned with the ridge formation with the sub-system components aligned parallel to the ridge formation RD. Moreover, the multiple sub-systems 210*a* can be axially spaced apart to one side of the ridge formation RD in the direction of the formation. Additionally or alternatively, a draft curtain DC can extend between or parallel to the preferred deluge sub-systems. The draft curtains DC can be appropriately oriented parallel or perpendicular to the ridge formation RD to appropriately section the attic space.

Figure 4C:
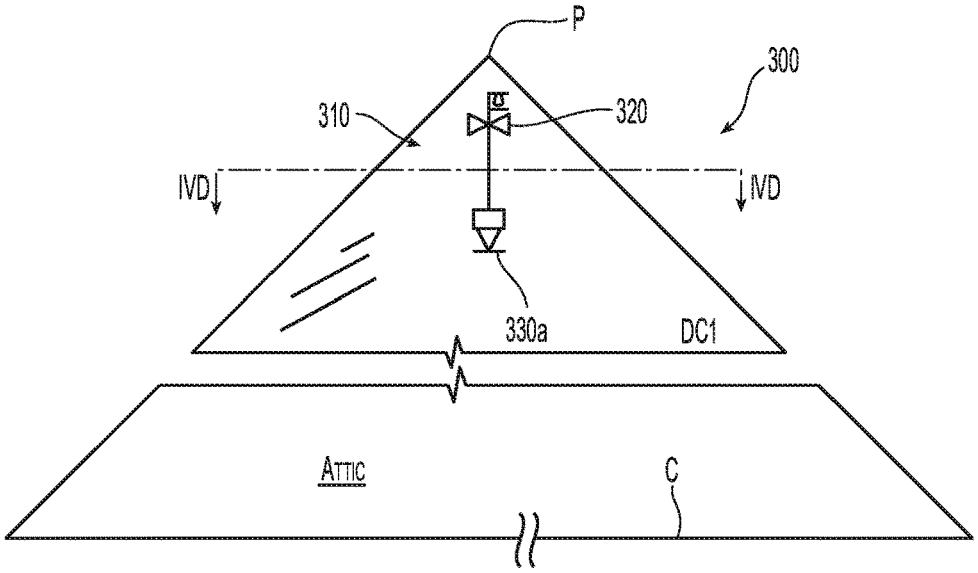
FIGS. 4C-4D are elevation and plan schematic views of another preferred attic fire protection system using a plurality of preferred sectional fire protection systems with draft curtains.
Figure 4D:
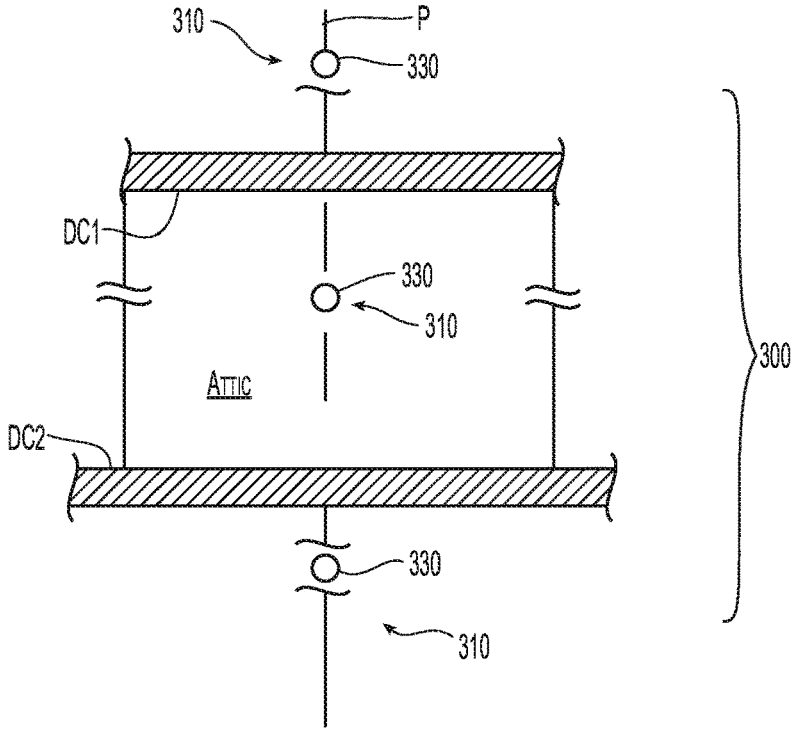

Shown in FIGS. 4C and 4D is another preferred embodiment of a sub-system 300 for providing sectional fire protection to an attic space divided by a plurality of draft curtains DC1, DC2 extending below and perpendicular to the peak P. Located proximate the peak region P is a fluid control device 320 with one fluid distribution device 330 depending from and axially aligned with the fluid control device 320. The fluid distribution device 330 preferably includes a deflector member 330*a* and is preferably axially located between the fluid control device 320 and the ceiling deck C, such that the fluid distribution device 330 distributes a preferred density ranging from 0.05-0.1 GPM/SQ. FT. and more preferably 0.05 GPM/SQ. FT. to less than 0.1 GPM/SQ. FT over the entire area between the draft curtain DC1, DC2 and across the span S of the attic space ATTIC upon operation of the fluid control device 320.

In one preferred embodiment, there is a sectional system 310 to protect a portion of an attic space ATTIC between first and second draft curtains DC1, DC2 defining an area A of 480 SQ. FT. to be protected. With a preferred design density of 0.05 GPM/SQ. FT, the area can be protected at a flow rate of 24 GPM from a preferred single fluid distribution device 330. In a preferred embodiment of system 300 hydraulically designed to a maximum flow rate of 120 GPM, a total of five sectional sub-systems 310 can be spaced about the attic space ATTIC. In a preferred hydraulic design at an appropriate design safety factor of, for example, 1.5 the fire protection system 300 can be hydraulic designed for the simultaneous operation of three sectional sub-systems 310 each flowing at a rate of 24 GPM. Where a preferred minimum operating pressure of 33 PSI is provided to the fluid control thermal detection device 320, the preferred flow rate of 24 GPM can be provided by a fluid distribution device defining a nominal K-Factor of 4.2 GPM/$(PSI)^{1/2}$. Accordingly, a total of 1,440 SQ. FT. of attic space can be protected by the system 300 having three preferred sectional sub-systems 310*a*, 310*b*, 310*c* each covering a preferred 480 SQ. FT.

Figure 5:
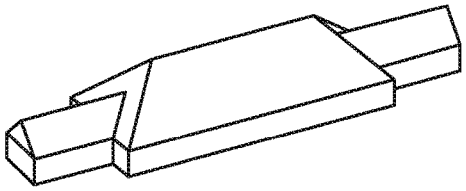
FIG. 5 is an illustrative embodiment of a complex roof configuration.
Figure 5A:
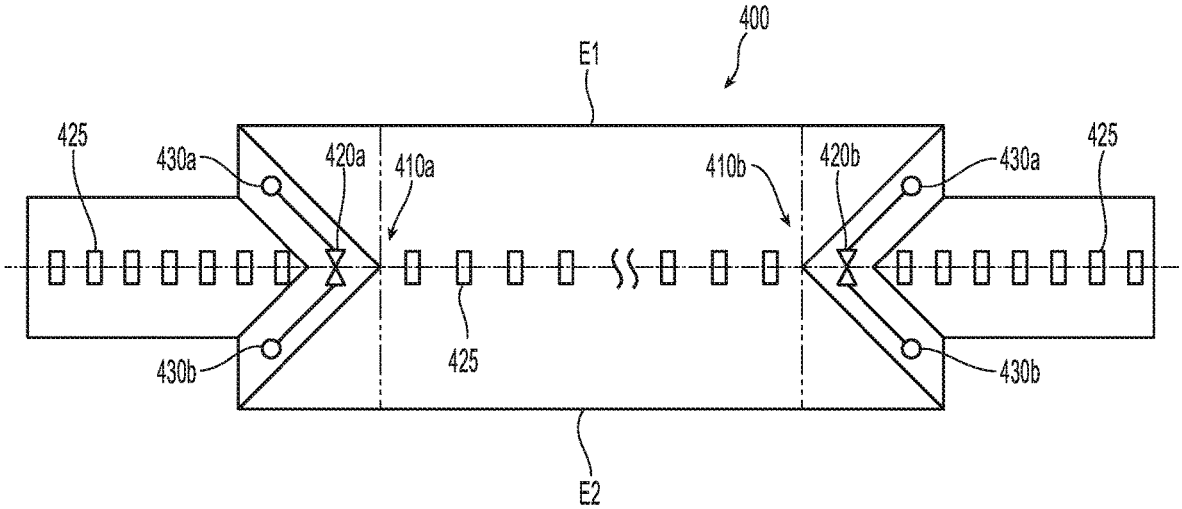
FIGS. 5A-5H are preferred embodiments of attic fire system for protecting the attic space of FIG. 5.
Figure 5B:
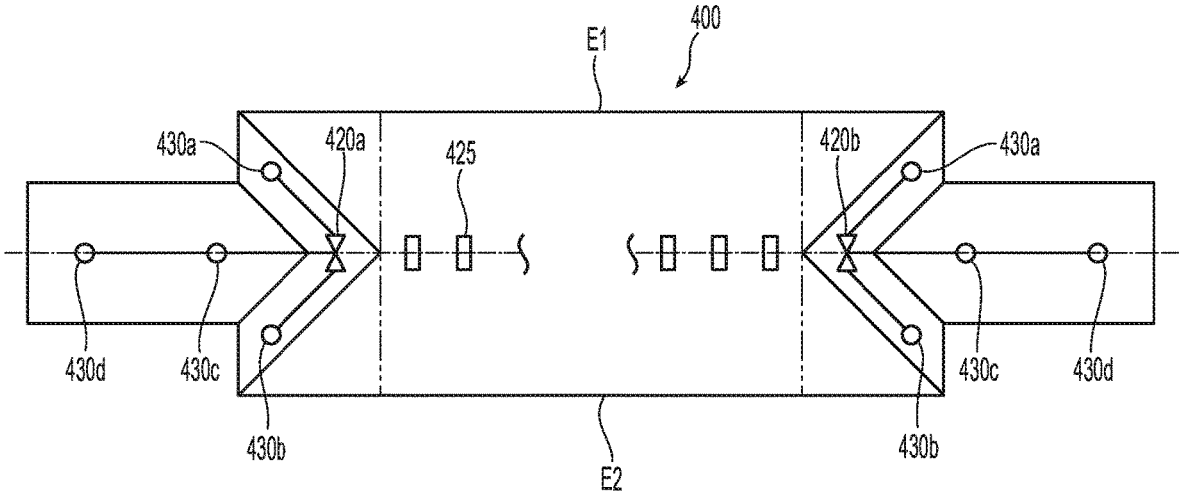

As shown, a complete attic space can be protected by one or more of the preferred sectional fire protection sub-systems. Alternatively or additionally, complex attic spaces can be protected by one or more of the preferred sectional fire protection systems alone or in combination with existing attic space fire protection systems or portions thereof, as shown and described in the Tyco Publication. As used herein, a "complex attic space" is a combination of roof configurations, such as for example, dormers, cross sections, and hip regions. A complex attic system configuration having a central or main hip roof with a maximum span S of forty feet (40 ft.) and two smaller gable ended attic spaces each having a maximum span SS of twenty feet (20 ft.) is shown in FIG. 5. The Tyco Publication described that such an attic space can be protected by either: (i) ninety-two (92) standard spray sprinklers having a nominal K-Factor of 4.2 hydraulically designed to a minimum design area of 1463 SQ. FT. with twenty-nine design sprinklers, providing a maximum total flow rate of 322 GPM to provide a density of 0.2 GPM/SQ. FT.; or (ii) a combination of twenty-four (24) Model BB3 sprinklers with thirty-four (34) AP sprinklers hydraulically designed over the same 1463 SQ. FT. design area with five Model BB3 sprinklers providing a flow of design and two Model AP Sprinklers to provide a total minimum flow of 147 GPM at a density of 0.1 GPM/SQ. FT.

It is believed that use of the preferred sectional system(s) 10 described herein, alone or in combination with the previously known attic systems, can reduce the total number of sprinklers and/or hydraulic demand over previously known fire protection systems to protect similarly sized and configured attic spaces. Shown in FIGS. 5A-5H are schematic illustrations of preferred sectional fire protection systems to provide protection of a similar complex roof configuration. In a preferred embodiment of a system 400 shown in FIG. 5A, each of the two end hip regions of the central main roof is protected by a preferred sectional sub-system 410*a*, 410*b* having a fluid control thermal detection device or valve 420*a*, 420*b* located proximate the peak region P and the intersection of the ridge formation RD with the hip region. Preferably depending from each fluid control device are two fluid distribution devices 430*a*, 430*b* each located proximate to and extending along the ridges of the hip. Each of the main roof and the end gable roofs are protected by Model BB3 sprinklers 425 axially aligned along the peak or ridge formations of the respective roof regions. More specifically, the main roof is protected by ten Model BB3 sprinklers 425 and each of the end gable roofs are protected by seven Model BB3 sprinklers 425. The Model BB3 sprinklers 425 are separately or independently pipe connected to the fluid supply source either in a wet pipe system or a dry pipe system. The fluid distribution devices 430*a*, 430*b* can be embodied by any open sprinkler or nozzle described herein provided the preferred sectional sub-system 410 and other sprinklers or fluid distribution devices provide a preferred 0.1 GPM/SQ. FT. fluid density or greater. In a preferred embodiment, the system 400 is hydraulically designed and a number of Model BB3 sprinklers 425 provide the preferred density of 0.1 GPM/SQ. FT. over a design area such as, for example, 1463 SQ. FT. More preferably, the system 400 is hydraulically designed such that the sectional sub-systems 410*a*, 410*b* and a select number of Model BB3 sprinklers provide the preferred density ranging from 0.05-0.1 GPM/SQ. FT. and more preferably 0.05 GPM/SQ. FT. to less than 0.1 GPM/SQ. FT over a preferred design area.

Alternate arrangements of the system 400*a* can be made to further reduce the total number of sprinklers in the system while maintaining the desired distribution density. More particularly, the number and location of fluid distribution devices are identified to provide the preferred designed fluid density ranging from 0.05-0.1 GPM/SQ. FT. In an alternate arrangement, shown in FIG. 5B, the number of Model BB3 sprinklers 425 can be further reduced by additionally or alternatively locating two fluid distribution devices 430*c*, 430*d* along the peak of gable ended roof sections in place of the seven Model BB3 sprinklers located in each of the gable ended roof sections.

Figure 5C:
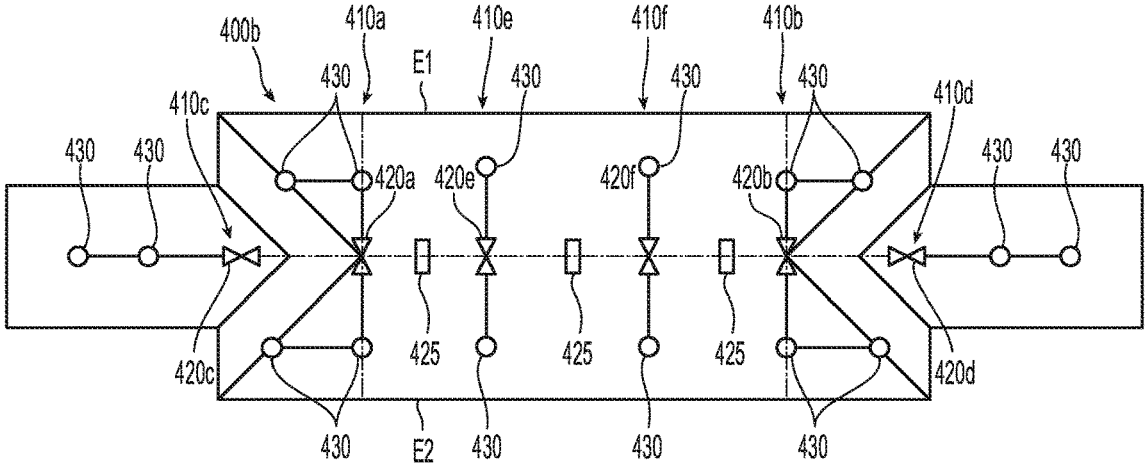

Shown in FIG. 5C is another alternate embodiment of the fire protection system 400*b* in which the number of Model BB3 sprinklers in the main roof is reduced and replaced by a plurality of preferred sectional fire protection deluge sub-systems 410*a*, 410*b*, 410*c*, 410*d*, 410*e*, 410*f*. Each of the section systems 410 includes a fluid control thermal detection device 420*a*, 420*b*, 420*c*, 420*d*, 420*e*, 420*f* spaced apart from one another and aligned proximate the peak region P of the main roof. Preferably evenly disposed between adjacent fluid control devices 420 is a Model BB3 sprinkler 425 located at the peak or ridge of the roof. Coupled to and depending from each of the fluid control thermal detection devices 420 are a plurality of fluid distribution devices 430 arranged in a manner as previously described. For example, four fluid control thermal detection devices 420*a*, 420*b*, 420*e*, 420*f* are evenly spaced proximate the peak region P vertically aligned with the ridge formation RD. Preferably, each of the four fluid control devices include two fluid distribution devices 430 aligned between the fluid control device 420 and an eaves regions E1, E2 to each side of the ridge formation RD. Intermittently disposed between the four fluid control devices 420*a*, 420*e*, 420*f*. 420*b* are three Model BB3 sprinklers 425*a*, 425*b*, 425*c*. Each of the two fluid control devices 420*a*, 420*b*, located at the ends of the main roof proximate the hip regions, preferably includes four fluid distribution devices 430 with two fluid distribution devices disposed along the angled hip of the hip regions. The gabled end roof sections are each preferably protected by a fluid control thermal detection device 420*c*, 420*d* with two fluid distribution devices 430 axially aligned with the peak of the roof section. In complex roofs without gabled ends, the hip sections can be alternatively protected by coupling preferably more than two fluid distribution devices 430 to the fluid control thermal detection devices 420*a*, 420*b* proximate the peak intersection with the hip regions at the ends of the main roof. More specifically, four or more open fluid distribution devices 430 can be arranged proximate the base of the hip region and coupled to the unactuated fluid control thermal detection device 420*a*, 420*b* to provide protection of the eaves in the hip region and in the area proximate the intersection of the sloping hip roof and the ceiling base.

Figure 5D:
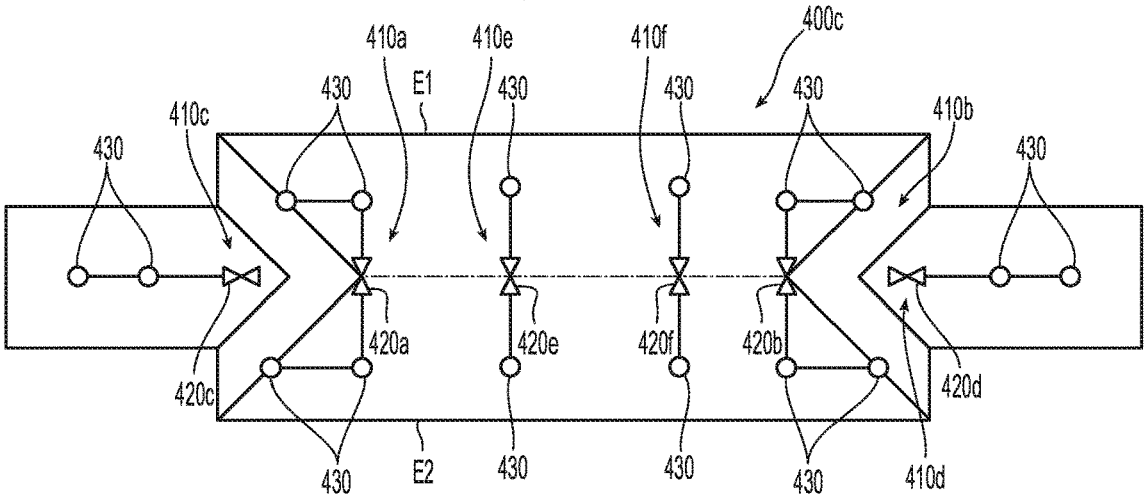
Figure 5E:
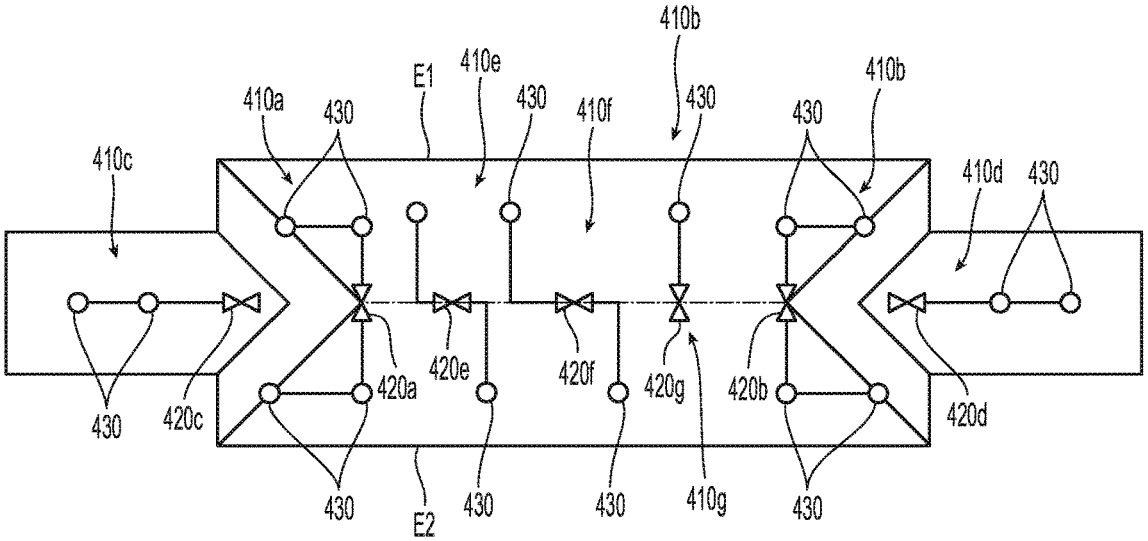
Figure 5F:
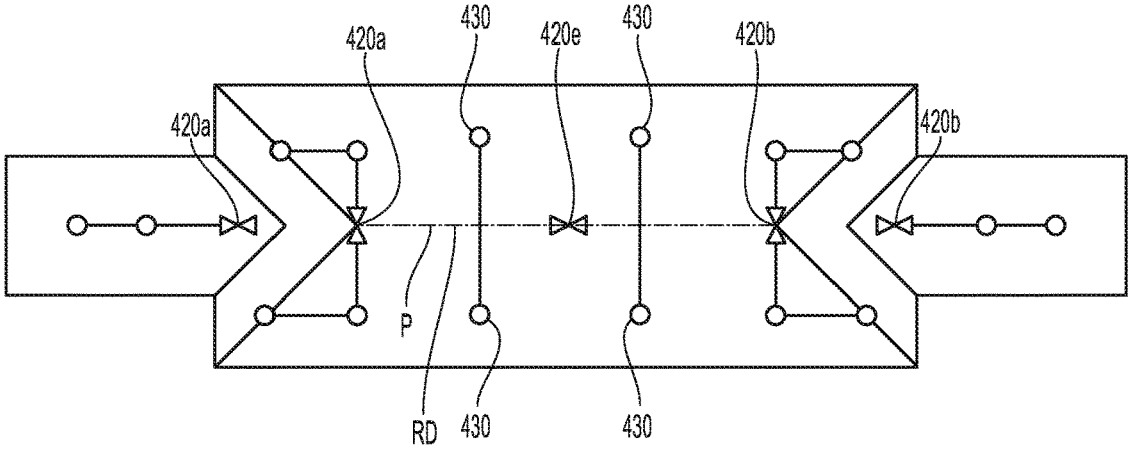

In another alternate embodiment of the system 400*c*, shown in FIG. 5D, the Model BB sprinklers are removed to further reduce the total number of sprinklers. The systems 400*b*, 400*c* are preferably hydraulically designed so that a number of sectional protection sub-systems 410 and Model BB3 sprinklers, where applicable, provide the preferred density ranging from 0.05-0.1 GPM/SQ. FT. and the more preferred 0.05 GPM/SQ. FT. to less than 0.1 GPM/SQ. FT fluid density over a preferred design area. Shown in FIGS. 5E and 5F are additional alternative embodiments of the attic fire protection system 400*d*, 400*e* in which the entire attic space is protected by a combination of various sectional fire protections sub-systems 410. In FIG. 5E, seven sub-systems 410*a*, 410*b*, 410*c*, 410*d*, 410*e*, 410*f*, 410*g* each include a fluid control thermal detection device 420*a*, 420*b*, 420*c*, 420*d*, 420*e*, 420*f*, 420*g* evenly spaced proximate the peak region P. Each of the four fluid control devices 420*a*, 420*b*, 420*c*, 420*d* includes at least one fluid distribution device 430 disposed between the fluid control device 420 and at least one of the eaves E1, E2. Preferably, the fluid distribution devices 430 coupled to the intermediately disposed fluid control devices 420*e*, 420*f*, 420*g* are in a staggered or off-set arrangement with one fluid control device 420*g* having only one fluid distribution device 430 coupled to it to provide the desired coverage in the staggered arrangement. The two fluid control devices 420*a*, 420*b* located at the ends of the main roof proximate the hip regions each preferably includes four fluid distribution devices 430 with two fluid distribution devices disposed along the angled hip of the hip regions. The gabled end roof sections are each protected by a fluid control thermal detection device 420*c*, 420*d* with two fluid distribution devices 430 axially aligned with the peak of the roof section.

In another alternate embodiment of the system 400*e*, shown in FIG. 5F, the total number of fluid control thermal detection devices 420 is reduced to three sectional systems to protect the central main roof section. Two fluid control devices 420*a*, 420*b* are preferably located at the ends of the main roof proximate the hip regions, along with four fluid distribution devices 430 that include two fluid distribution devices disposed along the angled hip of each hip region. A centrally disposed fluid control thermal detection device 420*e* is positioned proximate the peak region P. Preferably disposed about the central fluid control device 420*e* are four fluid distribution devices 430 in a preferred "H-shaped" formation to provide for fluid distribution about the peak P. The gabled end roof sections are each protected by a fluid control thermal detection device 420*c*, 420*d* with two fluid distribution devices 430 axially aligned with the peak of the roof section. The systems 400*d*, 400*e* are preferably hydraulically designed so that a select number of sectional protection sub-systems 410 provide the preferred density ranging from 0.05-0.1 GPM/SQ. FT. and more preferably 0.05 GPM/SQ. FT. to less than 0.1 GPM/SQ. FT over a preferred design area.

Figure 5G:
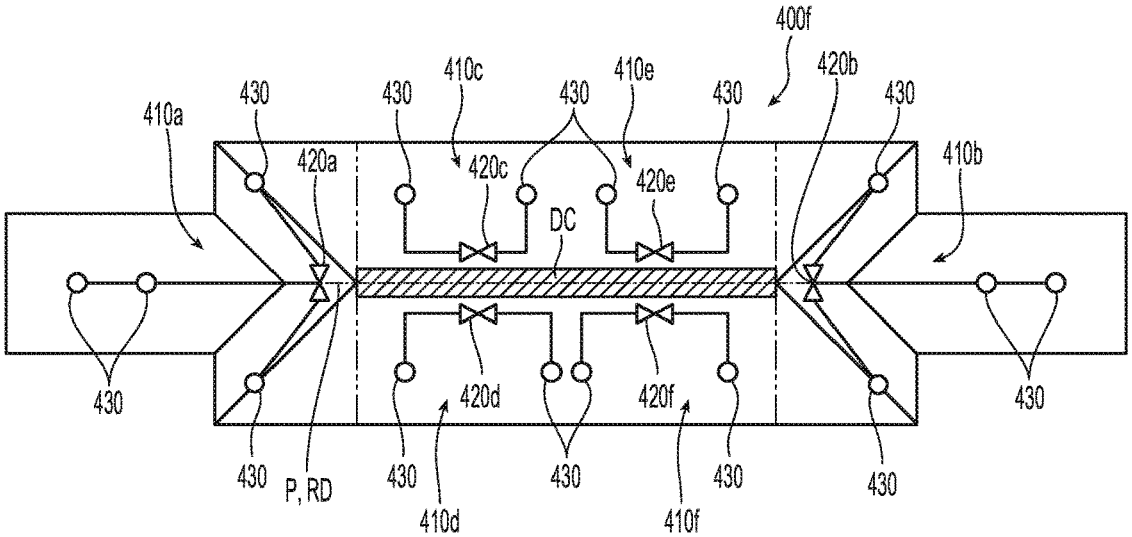
Figure 5H:
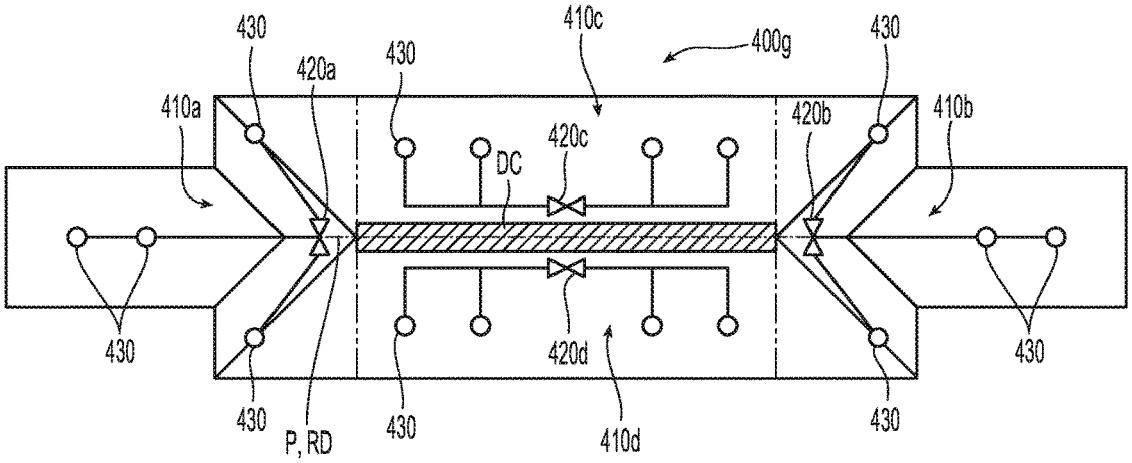

Shown in FIGS. 5G and 5H are additional alternative embodiments of the attic fire protection systems 400*f*, 400*g* with a draft curtain for protection of an attic space. In a preferred embodiment of a system 400*f* shown in FIG. 5G, each of the end hip regions of the central main roof is protected by a preferred sectional sub-system 410*a*, 410*b* having one fluid control thermal detection device 420*a*, 420*b* located proximate the peak region P and its intersection with the hip region and two fluid distribution devices 430 aligned along the peak of the gable ended roof sections. In an alternate arrangement, the fluid distribution devices in the hip region can be staggered in the hip region. More specifically, adjacent rows of sprinklers in the hip region below the sloping roof can be staggered in the direction from the ceiling base toward the peak and connected to the fluid distribution device.

As shown in FIGS. 5G and 5H, the main roof section is divided by a draft curtain DC that extends along the length of the peak P. Four sectional protection sub-systems 410*c*, 410*d*, 410*e*, 410*f* are evenly spaced along and about the peak region P and draft curtain DC of the main central roof section. Each fluid control device 420*c*, 420*d*, 420*e*, 420*f* has two fluid distribution devices 430 depending therefrom and located between the fluid control device 420 and one of the eaves regions E1, E2. In one preferred aspect, the fluid distribution devices 430 are axially spaced apart from one another in the direction of the peak by a distance of twenty feet (20 ft.).

In the alternate embodiment of the system 400*g*, as shown in FIG. 5H, the number of fluid control thermal detection devices is reduced in the main roof section of the attic configuration. In particular, two sectional protection sub-systems 410*c*, 410*d* are centered and disposed about the peak region P and draft curtain DC. Each fluid control device 420*c*, 420*d* has four fluid distribution devices 430 depending therefrom and located between the fluid control device 420 and one of the eaves regions E1, E2. The systems 400*f*, 400*g* are preferably hydraulically designed so that a select number of sectional protection sub-systems 410 provides the preferred density ranging from 0.05-0.1 GPM/SQ. FT. and more preferably 0.05 GPM/SQ. FT. to less than 0.1 GPM/SQ. FT over a preferred design area.

The preferred system configurations of FIGS. 5A-5H are for a roof span S of forty feet (40 ft.). It is believed that attic configurations of greater spans, such as for example, up to sixty feet (60 ft.) or up to a maximum span of eighty feet (80 ft.) can be protected by adding and positioning additional fluid distribution devices parallel to or in series with the previously described distribution devices of the sectional fire protection system. The expanded sectional fire protection systems are preferably hydraulically designed to provide the preferred fluid distribution density ranging from 0.05-0.1 GPM/SQ. FT. and more preferably 0.05 GPM/SQ. FT. to less than 0.1 GPM/SQ. FT over a preferred design area.

Figure 6A:
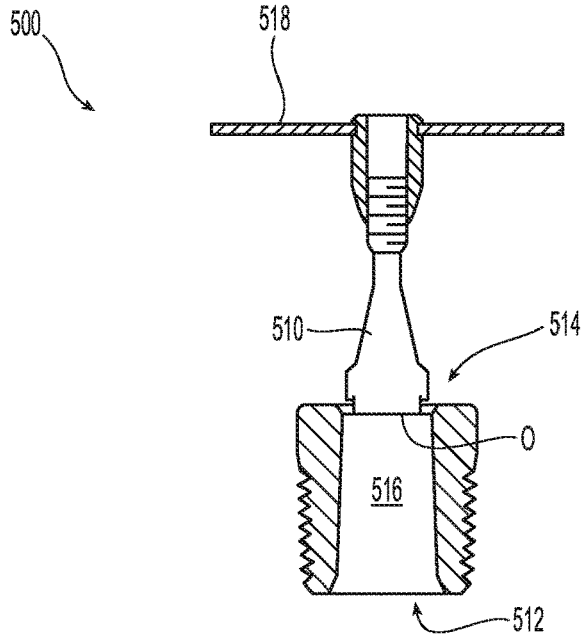
FIGS. 6A-6B are cross-sectional and elevation views of a preferred fluid distribution device for use in the systems of FIG. 1A.
Figure 6B:
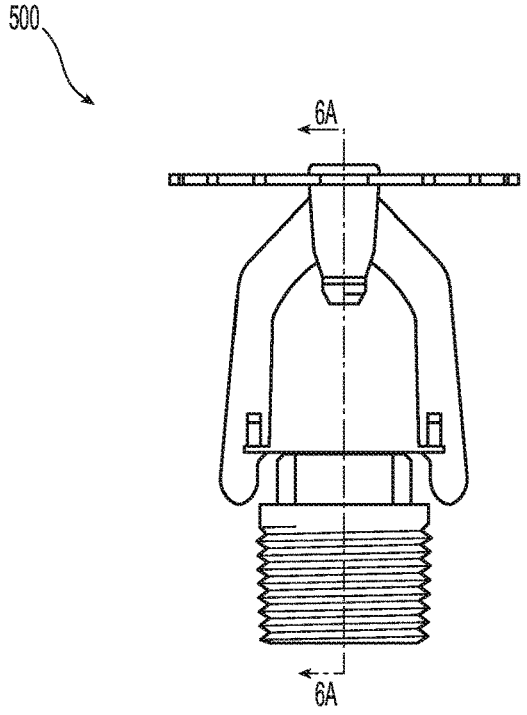

As previously noted, each fluid distribution device 30 of the preferred sectional systems described herein can be embodied as an open fire protection sprinkler, a fire protection nozzle or any other fluid carrying open conduit capable of dispersing firefighting fluid. Depending upon its type, the device 30 can include a fluid deflector or diffuser to define a coverage area of the device 30. The deflector or diffuser can be of any configuration or geometry provided the deflector can deliver a desired fluid distribution and density for the preferred installation location in order to provide the sectional protection of the attic space. The sprinkler can be configured for either an upright installation or a pendent installation. A preferred fluid distribution device embodied as an open frame fire protection sprinkler 500 is shown in FIGS. 6A and 6B. The sprinkler 500 includes a frame 510 having an inlet 512, and has a preferred nominal K-Factor of 11.2 GPM/(PSI)$^{1/2}$ or less, such as for example, a nominal K-Factor of 11.2 GPM/(PSI)$^{1/2}$ or 4.2 GPM/(PSI)$^{1/2}$. The discharge coefficient or K-factor characterizes the geometry of the passageway 516 and more particularly the orifice diameter O, which defines the flow rate from the sprinkler body. Industry accepted standards, such as for example, the National Fire Protection Association (NFPA) standard entitled, "NFPA 13: Standards for the Installation of Sprinkler Systems" (2013 ed.) ("NFPA 13") provide for a rated or nominal K-factor or rated discharge coefficient of a sprinkler as a mean value over a K-factor range. The K-factor is defined as a constant representing the discharge coefficient that is quantified by the flow of fluid in gallons per minute (GPM) from the outlet of the frame body divided by the square root of the pressure of the flow of fluid fed into the inlet of the frame passageway in pounds per square inch (PSI). The K-factor is expressed as GPM/(PSI)$^{1/2}$. For example for a K-factor of 11.2 or less, the following nominal K-factors (with the K-factor range shown in parenthesis) are: (i) 11.2 (10.7-11.7) GPM/(PSI)$^{1/2}$; (ii) 8.0 (7.4-8.2) GPM/(PSI)$^{1/2}$; (iii) 5.6 (5.3-5.8) GPM/(PSI)$^{1/2}$; (iv) 4.2 (4.0-4.4) GPM/(PSI)$^{1/2}$; (v) 2.8 (2.6-2.9) GPM/(PSI)$^{1/2}$; and (vi) 1.9 (1.8-2.0) GPM/(PSI)$^{1/2}$; or 1.4 (1.3-1.5) GPM/(PSI)$^{1/2}$. For the preferred sprinkler system 200 and the nominal K-factor of 11.2, the sprinkler has a preferred minimum operating pressure of thirteen pounds per square inch (13 PSI) to provide for a flow rate of forty gallons per minute (40 GPM). Alternate embodiments of the fluid distribution device 30 can include an open frame defining a nominal K-Factor of 11.2 or greater. For a K-factor of 11.2 or greater, the following nominal K-factors (with the K-factor range shown in parenthesis) are: (i) 11.2 (10.7-11.7) GPM/(PSI)$^{1/2}$; (ii) 14.0 (13.5-14.5) GPM/(PSI)$^{1/2}$; (iii) 16.8 (16.0-17.6) GPM/(PSI)$^{1/2}$; (iv) 19.6 (18.6-20.6) GPM/(PSI)$^{1/2}$; (v) 22.4 (21.3-23.5) GPM/(PSI)$^{1/2}$; (vi) 25.2 (23.9-26.5) GPM/(PSI)$^{1/2}$; (vii) 28.0 (26.6-29.4) GPM/(PSI)$^{1/2}$; and (viii) 33.6 (31.8-34.8) GPM/(PSI)$^{1/2}$. Alternate embodiments of the fluid distribution device 30 can include sprinklers having the aforementioned nominal K-factors or greater.

An appropriately sized fluid control thermal detection device 20 delivers firefighting fluid at a preferred minimum operating pressure, such as for example 13 PSI, to a fluid distribution device 530 having an appropriately sized orifice or discharge coefficient, such as for example, K-Factor 11.2 GPM/(PSI)$^{1/2}$, to impact the deflector 518 and provide for a preferred coverage area of up to 400 square feet. The deflector member 518 is preferably configured the same as the deflector of the Model AP with 4.2 or 5.6 K-Factor Specific Application Combustible Concealed Space Sprinklers from Tyco Fire Products LP, shown and described in technical data sheet TFP610 entitled, "Model BB, SD, HIP, and AP 'Specific Application Sprinklers For Protecting Attics" (December 2007).

Exemplary fire protection sprinklers for use in the preferred sectional fire protection systems 10 can also include known standard spray sprinklers, specific application attic sprinklers or other specific application sprinklers in their open or unsealed configuration. In particular, preferred known fire protection sprinklers for use in the sectional fire protection system can include: (i) the Model AP with 4.2 or 5.6 K-Factor Specific Application Combustible Concealed Space Sprinklers; or (ii) the Model WS Specific Application Window Sprinkler from Tyco Fire Products LP, shown and described in technical data sheet TFP620 entitled, "Model WS Specific Application Window Sprinklers Horizontal and Pendent Vertical Sidewall 5.6 K-factor" (May 2014). Any preferred open sprinkler frame and its deflector installed in a preferred sectional fire protection system described herein can be appropriately oriented with respect to the ceiling base C and/or roof deck RD to provide for the preferred fluid density over an appropriately sized and more preferably maximized coverage area at the preferred minimum operating pressure. Other known open frame fire protection sprinklers or nozzles can be identified for use in a preferred sectional fire protection system by examination of its fluid distribution and/or its performance in appropriate fire testing to effectively address a fire and deliver a preferred fluid distribution density when coupled to an appropriate fluid control thermal detection device.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A fire protection system for the protection of an attic space defined by a ceiling base, a roof deck disposed above the ceiling base, the roof deck being sloped with respect to the ceiling base to define a peak region, the system disposed in the attic space, the system comprising:

at least one sectional deluge sub-system for protection of a zone section of the attic space, the deluge sub-system including:

a fluid control thermal detection device located above the ceiling base within a maximum radial distance of the peak region, the maximum radial distance is less than or equal two feet, the fluid control thermal detection device having an inlet for connection to a fluid source and at least one outlet, a valve coupled with the inlet and the at least one outlet, and a thermal spot detection assembly coupled with the valve, the thermal spot detection assembly comprising at least one of a fusible assembly, a thermally responsive bulb, or an electrically responsive actuator; and at least one fluid distribution device comprising at least one of a deflector and a diffuser, the at least one fluid distribution device disposed between the roof deck and the ceiling base at a minimum distance greater than or equal to eight feet and less than or equal to twelve feet from an intersection of the roof deck and the ceiling base such that no fluid distribution device is closer to the intersection than the minimum distance, the fluid distribution device being pipe connected to the at least one outlet of the fluid control thermal detection device for receipt of firefighting fluid from the fluid control thermal detection device, and wherein the fluid distribution device is in an open state at a temperature less than a temperature at which the fluid control thermal detection device detects a fire condition.

2. The system of claim 1, wherein the roof deck slopes toward a ridge formation and the at least one deluge sub-system includes two fluid distribution devices with the fluid control thermal detection device between the two fluid distribution devices, the two fluid distribution devices and fluid control thermal detection device being aligned with one another in the direction of the ridge formation.

3. The system of claim 2, wherein the at least one deluge sub-system includes at least two deluge sub-systems disposed laterally about the ridge formation.

4. The system of claim 3, wherein a draft curtain depends from and extends along the ridge formation between the at least two deluge sub-systems.

5. The system of claim 2, wherein the at least one deluge sub-system includes at least two deluge sub-systems disposed laterally to one side of the ridge formation, the pair of deluge sub-systems being axially spaced apart in the direction along the ridge formation.

6. The system of claim 2, wherein the at least one deluge sub-system includes at least two deluge sub-systems axially spaced apart and disposed in line with the ridge formation.

7. The system of claim 6, wherein the at least two deluge sub-systems are located between two spaced apart draft curtains depending from and extending perpendicular to the ridge formation.

8. The system of claim 6, wherein the attic space includes a pair of eaves regions located laterally about the peak region, the ceiling base defining a span of eighty feet (80 ft.), the system including a plurality of automatic sprinklers located in the eaves regions and independent of the at least two deluge systems, the at least two deluge systems protecting the attic space between the ridge formation and the eaves regions.

9. The system of claim 1, wherein the roof deck slopes toward a ridge formation, the attic space includes at least one eaves region located laterally of the ridge formation, with the at least one fluid distribution device being located between the eaves region and the at least fluid control thermal detection device.

10. The system of claim 9, wherein the at least one fluid distribution device and the at least one fluid control thermal detection device are aligned with one another in a direction from the peak region toward the at least one eave region and perpendicular to the ridge formation.

11. The system of claim 9, wherein the at least one fluid distribution device is vertically aligned below the ridge formation.

12. The system of claim 9, wherein the at least one eave region includes a first eave region and a second eave region each disposed laterally of the ridge formation, the at least one deluge sub-system includes a plurality of deluge sub-systems, wherein in each deluge sub-system the at least one fluid distribution device and at least one fluid control thermal detection device are aligned with one another in a direction perpendicular to the ridge formation with the at least one fluid distribution device located between one of the first and second eaves regions and the at least fluid control thermal detection device.

13. The system of claim 12, wherein the fluid control thermal detection devices of the plurality of deluge sub-systems are axially spaced below and aligned with the ridge formation, adjacent deluge sub-systems being in a staggered arrangement with the at least one fluid distribution device of the deluge sub-systems being alternately located between the first and second eaves regions and the fluid control thermal detection devices to which the at least one fluid distribution devices are pipe connected.

14. The system of claim 12, wherein the plurality of deluge sub-systems include at least one pair of deluge sub-systems aligned with one another in the direction from the first eave region to the second eave region with the fluid control thermal detection devices of the at least one pair of deluge sub-systems are spaced adjacent one another with the ridge formation extending between the fluid control thermal detection devices of the at least one pair of deluge sub-systems.

15. The system of claim 14, wherein the at least one pair includes at least two pairs of deluge sub-systems, the two pairs being axially spaced apart in a direction parallel to the ridge formation.

16. The system of claim 12, wherein the plurality of fluid distribution devices are upright sprinklers.

17. The system of claim 12, wherein the plurality of deluge sub-systems are located between two draft curtains spaced apart in the direction of the ridge formation each draft curtain extending perpendicular to the ridge formation.

18. The fire protection system of claim 1, wherein the distance is a first distance, and the at least one fluid distribution device is located at a second distance from the peak region that is greater than or equal to two times and less than or equal to four times the maximum radial distance.

19. The fire protection system of claim 1, wherein the at least one fluid distribution device comprises a plurality of fluid distribution devices arranged relative to one another to have a fluid output density no greater than 0.01 gallons per minute per square foot.

* * * * *